United States Patent [19]

Young et al.

[11] Patent Number: 4,758,493

[45] Date of Patent: Jul. 19, 1988

[54] MAGNETIC SINGLE COMPONENT TONER COMPOSITIONS

[75] Inventors: Eugene F. Young, Rochester; Thomas J. McGowan, Webster, both of N.Y.

[73] Assignee: Xerox Corporation, Stamford, Conn.

[21] Appl. No.: 934,382

[22] Filed: Nov. 24, 1986

[51] Int. Cl.[4] ..... G03G 9/14

[52] U.S. Cl. ..... 430/122; 430/903; 430/106.6; 355/140

[58] Field of Search ..... 430/107, 106.6, 903

[56] References Cited

U.S. PATENT DOCUMENTS

| | | | |
|---|---|---|---|
| 3,106,479 | 10/1963 | Evans | 430/106.6 |
| 3,938,992 | 2/1976 | Jadwin et al. | 430/124 |
| 4,272,600 | 6/1981 | Sypula et al. | 430/106 |
| 4,301,228 | 11/1981 | Kori et al. | 430/110 |
| 4,433,040 | 2/1984 | Nimura et al. | 430/109 |
| 4,495,268 | 1/1985 | Miyakawa | 430/122 |
| 4,499,168 | 2/1985 | Mitsuhashi | 430/109 X |
| 4,504,562 | 3/1985 | Miyakawa et al. | 430/106.6 |
| 4,517,268 | 5/1985 | Gruber et al. | 430/39 |
| 4,556,624 | 12/1985 | Gruber et al. | 430/110 |
| 4,562,136 | 12/1985 | Inoue et al. | 430/107 |
| 4,569,896 | 2/1986 | Perez | 430/106.6 |
| 4,609,607 | 9/1986 | Takagi et al. | 430/106.6 |

FOREIGN PATENT DOCUMENTS

| | | |
|---|---|---|
| 2916079 | 3/1981 | Fed. Rep. of Germany . |

*Primary Examiner*—J. David Welsh

*Attorney, Agent, or Firm*—Ronald Zibelli

[57] ABSTRACT

A single component toner composition comprised of crosslinked resin particles, a low molecular weight wax component, magnetite, and external additive particles selected from the group consisting of first flow aid additive particles, and second metal oxide additive particles.

5 Claims, No Drawings

MAGNETIC SINGLE COMPONENT TONER COMPOSITIONS

BACKGROUND OF THE INVENTION

This invention is generally directed to toner compositions, and more specifically to single component toner compositions containing therein magnetite particles and crosslinked resin components. In accordance with one embodiment of the present invention, there are provided toner compositions comprised of crosslinked resin particles, low molecular weight waxy materials including polyethylene and polypropylenes, magnetites, first and second additive particles, and certain optional charge enhancing additives. The aforementioned toner compositions are particularly useful for affecting the development of images in electrostatographic imaging systems wherein the utilization of carrier particles are avoided.

Single component toner compositions are known, reference for example U.S. Pat. No. 4,311,779, which discloses a magnetic developer with from about 45 to about 65 percent by weight of a magnetic material, and wherein there is selected a binder including specific copolymers of conjugated diolefins such as styrene butadiene. It is indicated in column 4, beginning at line 60, of this patent that it is necessary that the amount of finely divided magnetic material to be incorporated into the developer should be 45 to 65 percent by weight, and particularly 50 to 60 percent by weight. A similar teaching is present in related U.S. Pat. No. 4,315,064 directed to a copying method wherein the toner as illustrated in the U.S. Pat. No. 4,311,779 is utilized. In addition, disclosed in U.S. Pat. No. 4,495,267 is a magnetic toner with improved humidity dependency containing magnetite in a binder, and wherein the water soluble component content of the magnetite is lower that about 0.15 percent by weight, and the water content of the magnetite at a temperature of 20° C., and a relative humidity of 60 percent, is lower that 0.3 percent by weight. Furthermore, illustrated in U.S. Pat. No. 4,495,268 is a photocopying process wherein a magnetic developer is selected with specific linear polymers which are not believed to be crosslinked and wherein there is selected a special form of isometric magnetite. Also of interest is U.S. Pat. No. 4,499,168 which is directed to developer powders comprising one or more vinyl type copolymers exhibiting peak value molecular weights, and an ethylene type olefin homopolymer or copolymer. Moreover, in U.S. Pat. No. 4,229,900 the disclosure of which is totally incorporated herein by reference, there is illustrated a process for developing images by electrically transferring a magnetic developer to an image bearing member in the presence of a magnetic field, and wherein the magnetic developer is insulating and contains from 10 to 50 percent by weight of magnetic toner particles which are from about 20 to 25 microns in size.

Described in U.S. Pat. No. 4,556,624 are electrostatic toner compositions comprised of a polyblend mixture of a crosslinked copolymer composition, and a second polymer, pigment particles, a wax component of a molecular weight of from about 500 to about 20,000, and a charge enhancing additive. As first resin particles, there may be selected crosslinked copolymer resins including styrene alkyl methacrylate crosslinked with, for example, divinyl benzene. The disclosure of the aforementioned patent is totally incorporated herein by reference.

In addition, there is illustrated in U.S. Pat. No. 4,433,040, the disclosure of which is totally incorporated herein by reference, electrophotographic toners containing a metal complex dye including dyes similar to those selected for the present invention as optional components with the primary exception that the dyes of the present invention contain thereon an $NH_4+$ moiety, rather than an H+ moiety as recited in the claims of the U.S. Pat. No. 4,433,040, although such a moiety is disclosed therein. Examples of resins that may be selected are outlined in column 2, beginning at line 64, none of which appear to encompass crosslinked resins; and further there is no indication in this patent with respect to, for example, the selection of first and second additive components selected for the developer compositions of the present invention. Furthermore, in U.S. Pat. No. 4,562,136 there is illustrated a two component dry type developer with the optional charge enhancing additives that may be selected for the developer compositions of the present invention wherein, for example, the anion A is $NH_4+$. This patent describes a two component developer with carrier particles coated with a silicone resin and toner particles containing the monoazo metal complex dye of the formula as illustrated, for example, in claim 1. The disclosure of the aforementioned patent, particularly with respect to the charge enhancing additive, is totally incorporated herein by reference.

Other patents of background interest include U.S. Pat. Nos. 4,563,409; 4,590,141; 4,401,741; 4,404,269; 4,388,396; and 4,576,888. In U.S. Pat. No. 4,563,409 there is disclosed a symmetric 2:1 metal complex of the formula as recited in claim 1, and an electrophotographic toner containing from 1 to 50 percent by weight of the aforementioned metal complex; and from about 50 to 99 percent by weight of a resin, reference claim 3, for example; U.S. Pat. No. 4,590,141 is directed to carrier particles for use in two component dry developers comprising a core material and a silicone resin layer coated on the surface of said core material and as an agent against abrasion of the carrier particles inorganic fortifying filler particles selected from the group consisting of silicon carbide and potassium titanate; U.S. Pat. No. 4,401,741 is directed to a magnetic one component type developer comprising an electrically insulating binder medium and a magnetic material powder with a positive or negative charge control agent dispersed in the binder medium, and a charge control agent having a polarity opposite to that of said charge control agent at a weight ratio of from 1/0.05 to 1/1.5; U.S. Pat. No. 4,404,269 is directed to a two component composite developer which comprises a mixture of magnetic toner particles and nonmagnetic toner particles, the improvement wherein the magnetic toner particles are comprised of certain components in specific ratios, and nonmagnetic toner particles comprising specific components inclusive of a negative charge control agent; U.S. Pat. No. 4,388,396 is directed to a process for developing electrostatic images wherein there is included in the developer an offset preventing agent selected from the group consisting of aliphatic fluorocarbon compounds and fluorochlorocarbon compounds; and U.S. Pat. No. 4,576,888 is directed to a toner comprising azoic pigment having a silica core as a coloring component and a coating of a mono or polyazoic dye chemically bonded to the surface of the silica core through an aminosilane coupling agent.

Although the aforementioned toner compositions are suitable for their intended purposes, there continues to be a need for new specific toner compositions, particularly single component compositions useful in electrostatographic imaging systems. More specifically, there is a need for toner compositions that are particularly useful in jumping development imaging processes as disclosed in the aforementioned U.S. Pat. No. 4,229,900. Also, there is a need for single component toner compositions which when incorporated into electrostatic imaging processes enable images of excellent resolution for extended time periods. Moreover, there is a need for single component toner compositions with crosslinked resin particles wherein the developed images are effectively transferred to suitable supporting substrates. There is also a need for single component toners which retain their homogeneous characteristics during the melt mixing process. In addition, there is a need for single component toners wherein pigments such as carbon black are not present. Furthermore, there is a need for single component toner compositios which, when incorporated into electrostatographic imaging and printing apparatuses there can be obtained images with high solid area density (1.1 density units or higher), high density line copy, uniform halftones with acceptable toner reproduction curves, clean background areas, and suitable transfer characteristics.

SUMMARY OF THE INVENTION

It is an object of the present invention to provide toner compositions with the above noted advantages.

In another object of the present invention there are provided single component toner compositions containing therein crosslinked toner resins.

Additionally, in another object of the present invention there are provided single component magnetic toner compositions containing additives, low molecular weight waxy components therein, and crosslinked resins.

Additionally, in a further object of the present invention there are provided single component toner compositions with specific additives therein including flow aids such as colloidal silics, cerium, and other rare earth oxides.

Also, in another object of the present invention there are provided single component toner compositions with charge enhancing additives therein.

In yet still another object of the present invention there are provided processes for affecting the development of images in electrostatographic imaging apparatuses, including those employing jumping development.

Another object of the present invention resides in the provision of a single component toner containing cubicle magnetite such as Mapico Black thereby enabling images of excellent resolution with substantially no background deposits in xerographic imaging processes.

These and other objects of the present invention are accomplished by providing single component toner compositions comprised of resin particles, magnetite components, low molecular weight waxy components, first additive particles, second additive particles, and certain charge enhancing additive components. In one important embodiment of the present invention there are provided single component toner compositions comprised of crosslinked of styrene methacrylate, a wax component of a moleculare weight of less than about 6,000, magnetite particles, first flow additive particles of colloidal silica, second additive particles of cerium oxide, and certain charge enhancing additives.

Illustrative examples of toner resins which are crosslinked, and thus useful for incorporation into the toner and developer compositions of the present invention include, for example, polyesters, styrene/butadienes, styrene acrylates, styrene/methacrylates, epoxies, vinyl resins and polymeric esterification products of a dicarboxylic acid and a diol comprising a diphenol. Suitable vinyl components include homopolymers or copolymers of two or more vinyl monomers. Examples of vinyl monomeric units are styrene, p-chlorostyrene, ethylenically unsaturated mono-olefins such as ethylene, propylene, butylene, isobutylene and other similar olefins; vinyl esters such as vinyl acetate, vinyl butyrate and the like; esters of alphamethylene aliphatic monocarboxylic acids such as methyl acrylate, ethyl acrylate, n-butylacrylate, isobutyl acrylate, methyl methacrylate, ethyl methacrylate, butyl methacrylate and the like; diolefins including styrene butadiene copolymers, and the like.

The preferred crosslinked toner resins are selected from polystyrene methacrylates, polyesters such as those descirbed in U.S. Pat. No. 3,655,374, the disclosure of which is totally incoporated herein by reference, polyester resins resulting from the condensation of aromatic dicarboxylic acids or esters thereof with glycols such as 1,3 butanediol, and pentaerythritol, and Pliolite resins. The Pliolite resins are believed to be copolymer resins of styrene and butadiene, wherein the styrene is present in an amount of from about 80 weight percent to about 95 weight percent, and the butadiene is present in an amount of from about 5 weight percent to about 20 weight percent.

The resins illustrated herein are crosslinked by known processes, including during polymerization processing with various known crosslinking compositions including aromatic and nonaromatic substances, such as divinylbenzene, ethylene glycol dimethylacrylate, and the like. Other crosslinking compounds can be used providing the objectives of the present invention are attained. It is important with respect to the present invention that crosslinked resins be selected since it is in this manner that there is provided a reduction in undesirable offsetting of the toner image to the fuser rolls thus enabling toner to be transmitted to the fuser pressure roll and thereafter to the image copy being generated. Also, with the toner compositions of the present invention containing crosslinked resins, extended fuser wearability, and improved release characteristics associated with the transfer of the developed toner image from the imaging member to a suitable substrate such as paper are achieved.

Generally, the crosslinking component in an amount of from 0.1 percent to about 15 percent by weight based on the total monomer present are reacted in the presence of the aforementioned monomers at a temperature of from about 35° C. to about 150° C. until crosslinking is effected. By crosslinking, in accordance with the present invention, is meant to cause the resin polymer chains to be bonded with the crosslinking materials by covalent bonding enabling the formation of a polymer network. The degree and extent of crosslinking is determined by known processes including glass transition temperature measurements, $CHCl_3$ unsoluble gel content, rheology, and the like.

A particularly preferred resin selected for the toner composition of the present invention is a styrene n-butyl methacrylate containing about 58 percent by weight of styrene and about 42 percent by weight of n-butyl methacrylate, wherein the aforementioned monomers have been polymerized with the crosslinking material divinyl benzene in the amount of from about 0.1 to about 0.3 percent, and wherein the $CHCl_3$ soluble polystyrene equivalent weight average molecular weight is from about 60,000 to about 120,000.

As examples of magnetites selected for the toners of this invention, and present, for example, in an amount of from about 30 to about 50 percent by weight, and preferably from about 35 to about 40 percent by weight, which magnetites are a mixture of iron oxides, there are selected Mapico Blacks, Pfizer Blacks, Bayferrox available from Mobay Chemical Corporation; mixtures thereof; and the like.

The waxy components incorporated into the toner compositions of the present invention are believed to be of a weight average molecular weight of from between about 500 to about 20,000, and preferably are of a weight average molecular weight of from about 1,000 to about 6,000. Illustrative examples of low molecular weight waxy materials selected for the toner compositions of the present invention are polyethylenes commercially available from Allied Chemical and Petrolite Corporation; Epolene N-15, commercially available from Eastman Chemical Products Inc.; Viscol 550P, a low molecular weight polypropylene available from Sanyo Kasei K. K.; and the like. The commercially available polyethylenes selected have a molecular weight of from about 1,000 to about 2,000, while the commercially available polypropylenes incorporated into the toner compositions of the present invention are of a molecular weight of about 4,000 to about 5,000. Many of the polyethylene and polypropylene compositions useful in the present invention are illustrated in British Pat. No. 1,442,835, the disclosure of which is totally incorporated herein by reference.

Further, the aforementioned low molecular weight wax materials can be incorporated into the toner compositions in various effective amounts; however, generally these waxes are present in an amount from about 1 percent by weight to about 10 percent by weight, and preferably are present in an amount of from about 2 percent by weight to about 7 percent by weight. The blended charge enhancing additives illustrated herein are present, for example, in an amount of from about 0.5 percent to about 20 percent by weight, and preferably from about 1 percent by weight to about 5 percent by weight based on the total weight of the toner particles. Other amounts of waxes, and charge enhancing additives can be selected providing the objectives of the present invention are achievable.

As first flow additive particles, there can be selected various colloidal silicas in amounts of from about 0.1 percent by weight to about 5 percent by weight and preferably 0.1 percent by weight to about 1 percent by weight, reference for example U.S. Pat. No. 3,900,588, the disclosure of which is totally incorporated herein by reference. Particularly useful as the first additive is Aerosil R972 present in an amount of about 0.8 percent by weight.

As second additive particles, there is selected in an amount of from about 0.1 percent by weight to about 5 percent by weight, and preferably in an amount of from about 0.1 percent by weight to about 1 percent by weight, various oxides such as cerium oxide, aluminum oxide, strontium titanate, mixtures thereof; and the like. A particularly preferred second additive particle is cerium oxide present in an amount of from about 0.3 to about 0.3 percent by weight. The aforementioned additives are preferably utilized as external additives, that is, the toner composition is initially prepared and subsequently admixed with the first additive and second additive particles rather than formulating the toner composition by admixing the resin particles with the first and second additive particles.

As the charge enhancing additive generally present in an effective amount there are selected specific spilon black chromate dyes, and more specifically Aizen Spilon Black, ammonium bis[1-(3, 5-dinitro-2 hydroxyphenyl) azo-3-(N-phenyl carbamoyl)-2-napthalenolate]-chromate dye known as TRH, and available from Hodogaya Chemical. This additive is illustrated in U.S. Pat. No. 4,433,040, the disclosure of which is totally incorporated herein by reference; and U.S. Pat. No. 4,562,136, the disclosure of which is totally incorporated herein by reference. Also, other similar charge additives of the aforementioned patents may be selected for the toner compositions of the present invention providing the objectives thereof are achievable. The aforementioned additive enables the resulting toner composition to retain its negative charge. Accordingly, this additive is functioning as a negative charge enhancing additive. Moreover, the resulting single component toner compositions with the dye charge enhancing additives therein have an average particle size diameter of from about 10 to about 20 microns, and preferably from about 11 to about 13 microns. In addition, the melt index of the single component toner compositions of the present invention at 190° C. and a 10 kilogram load is from about 120 to about 300 grams/10 seconds.

The single component toner compositions of the present invention are particularly useful in electrostatic imaging systems, especially those with jumping development, jumping development being a development process that occurs in a developing apparatus equipped for developing a latent image by applying a one component developer composition to a latent image, comprising: (i) a means for transporting the developer composition to a developing station; (ii) a means for supplying the developer composition to the transporting means, the supplying means being positioned to face the transporting means with a gap therebetween; (iii) a means for limiting the thickness of the layer of the developer composition formed on the supplying means to be less than the gap between the transporting means and the supplying means to form a clearance between the transporting means and the layer of developer composition; and (iv) a means for applying an AC voltage across the gap between the transporting means and the supplying means to cause the developer composition to become airborne from the supplying means to the transporting means across the clearance, reference for example U.S. Pat. No. 4,378,158, the disclosure of which is totally incorporated herein by reference, which method comprises the formation of an electrostatic latent imaging member, contacting the image with the toner composition of the present invention, followed by transferring the developed image to a suitable substrate such as paper, and permanently affixing the image thereto by various suitable means inclusive of heat.

As photoconductive members for the aforementioned imaging apparatuses, there may be selected selenium, selenium alloys including selenium arsenic; selenium arsenic tellurium; halogenated selenium substances;

halogenated selenium alloys; cadmium sulfide; hydrogenated amorphous silicon; and the like.

The following examples are being supplied to further define specific embodiments of the present invention, it being noted that these examples are intended to illustrate and not limit the scope of the present invention. Parts and percentages are by weight unless otherwise indicated.

EXAMPLE I

There was prepared by melt blending, followed by mechanical attrition, a single component toner composition comprised of 58 percent by weight of a styrenebutyl methacrylate copolymer (58/42) crosslinked with 0.2 percent by weight of divinyl benzene; 37 percent by weight of Mapico Black; 4 percent by weight of polypropylene wax available as Viscol 550P from Sanyo Corporation; and 1 percent by weight of the charge enhancing additive Aizen Spilon Black, Ammonium bis[1-(3,5-dinitro-2 hydroxyphenyl)azo-3-(N-phenylcarbamoyl)-2-napthalenolate) chromate dye availabe as TRH from Hodogaya Chemical; and thereafter there was added to the formulated toner composition 0.8 percent by weight of Aerosil R972, and 0.6 percent by weight of cerium oxide.

The aforementioned toner composition was then incorporated into an electrostatographic imaging apparatus with jumping development, which apparatus is available as the Canon NP210, and wherein there was selected a cadmium sulfide photoconductor. Subsequent to development, there resulted images of high resolution with substantially no background deposits and solid area densities of greater than 1.10 density units. Also, the lines obtained on the final fused copies were an intense dark black and halftones were of a uniform appearance with acceptable tone reproduction curves.

EXAMPLE II

A toner composition was prepared by repeating the procedure of Example I with the exception that there was selected 0.3 percent by weight of the Aerosil R972, and substantially similar results were obtained.

EXAMPLE III

A toner composition was prepared by repeating the procedure of Example I with the exception that there was selected 57 percent by weight of the resin particles, and when initially formulating the toner composition there was added thereto 1 percent by weight of the charge enhancing additive of Example I, and substantially similar results were obtained.

EXAMPLE IV

A toner composition was prepared by repeating the procedure of Example I with the exception that there was selected 57 percent by weight of a styrene n-butyl methacrylate resin crosslinked with 0.4 percent by weight of divinyl benzene; 37 percent by weight of the magnetite Mapico Black; 5 percent by weight of polypropylene wax with a molecular weight of less than 6,000 available as Viscol 550P; and 1 percent by weight of the TRH charge enhancing additive. Subsequently, there was added to the aforementioned toner composition 0.8 percent by weight of Aerosil which is functioning as a flow additive, and 0.6 percent by weight of cerium oxide ($CeO_2$).

There resulted, subsequent to the development of images in accordance with the procedure as described in Example I, images with substantially no background deposits, and with typical solid area densities of 1.4.

Other modifications of the present invention will occur to those skilled in the art based upon a reading of the present disclosure. These are intended to be included within the scope of this invention.

What is claimed is:

1. An improved method of imaging comprising: (a) forming a latent image in a developing apparatus equipped for developing a latent image by applying a one component developer composition to a latent image, comprising: (i) means for transporting the developer composition to a developing station; (ii) means for supplying the developer composition to the transporting means, the supplying means being positioned to face the transporting means with a gap therebetween; (iii) means for limiting the thickness of the layer of the developer composition formed on the supplying means to be less than the gap between the transporting means and the supplying means to form a clearance between the transporting means and the layer of developer composition; and (iv) means for applying an AC voltage across the gap between the transporting means and the supplying means to cause the developer composition to become airborne from the supplying means to the transporting means across the clearance; (b) developing the latent image with a single component toner composition comprising crosslinked resin particles, a low molecular weight wax component, magnetite, first flow aid external additive particles comprising colloidal silica compositions, and second metal oxide external additive particles selected from the group consisting of cerium oxide, aluminum oxide, strontium titanate, and mixtures thereof; (c) transferring the developed image to a substrate; and (d) permanently affixing the image to the substrate.

2. A method of imaging in accordance with claim 1 wherein the resin particles are selected from the group consisting of a crosslinked styrene methacrylate and a crosslinked styrene butylmethacrylate, and the low molecular weight wax is selected from the group consisting of polyethylene and polypropylene with a molecular weight of less than 6,000.

3. An improved method of imaging in accordance with claim 1 wherein the resin particles are present in an amount of from about 50 to about 70 percent by weight, the low molecular weight wax is present in an amount of from about 1 to about 10 percent by weight, the magnetite particles are present in an amount of from about 35 to about 45 percent by weight, the first flow aid colloidal silica external additive particles are present in an amount of from about 0.1 to about 1.5 percent by weight, and the second metal oxide external additive particles are present in an amount of from about 0.1 to about 1.0 percent by weight.

4. An improved method of imaging in accordance with claim 1 wherein the toner composition contains the charge enhancing additive Aizen Spilon Black, ammonium bis[1-(3,5-dinitro-2-hydroxyphenyl)azo-3(N-phenylcarbamoyl)-2-napthalenolate]chromate dye in an amount of from about 0.1 to about 10 percent by weight.

5. An improved method of imaging in accordance with claim 4 wherein the second metal oxide external additive particles comprise cerium oxide.

* * * * *